US010876195B2

(12) United States Patent
Koll et al.

(10) Patent No.: US 10,876,195 B2
(45) Date of Patent: Dec. 29, 2020

(54) METHOD FOR PRODUCING PRESS-HARDENED COMPONENTS CONSISTING OF STEEL SHEETS OR STEEL STRIPS COMPRISING AN ALUMINIUM-BASED COATING, AND PRESSED-HARDENED COMPONENT THEREFROM

(71) Applicants: Salzgitter Flachstahl GmbH, Salzgitter (DE); Volkswagen AG, Wolfsburg (DE)

(72) Inventors: Thomas Koll, Braunschweig (DE); Marc Debeaux, Hildesheim (DE); Friedrich Luther, Gehrden (DE); Haucke-Frederik Hartmann, Herzberg (DE); Jan-Frederik Lass, Wolfsburg (DE); Matthias Graul, Brome (DE)

(73) Assignees: Salzgitter Flachstahl GmbH, Salzgitter (DE); Volkswagen Aktiengesellschaft, Wolfsburg (DE)

( * ) Notice: Subject to any disclaimer, the term of this patent is extended or adjusted under 35 U.S.C. 154(b) by 199 days.

(21) Appl. No.: 16/072,119

(22) PCT Filed: Feb. 2, 2017

(86) PCT No.: PCT/EP2017/052266

§ 371 (c)(1),
(2) Date: Jul. 23, 2018

(87) PCT Pub. No.: WO2017/137304

PCT Pub. Date: Aug. 17, 2017

(65) Prior Publication Data

US 2019/0040513 A1 Feb. 7, 2019

(30) Foreign Application Priority Data

Feb. 8, 2016 (DE) ..... 10 2016 102 172
Feb. 12, 2016 (DE) ..... 10 2016 102 504

(51) Int. Cl.
*C23C 2/12* (2006.01)
*C23C 2/40* (2006.01)
(Continued)

(52) U.S. Cl.
CPC ..... *C23C 2/12* (2013.01); *C21D 1/673* (2013.01); *C21D 8/0284* (2013.01); *C21D 9/46* (2013.01);
(Continued)

(58) Field of Classification Search
None
See application file for complete search history.

(56) References Cited

U.S. PATENT DOCUMENTS

2007/0256808 A1 11/2007 Fleischanderl et al.
2010/0276001 A1 11/2010 Sawada et al.
(Continued)

FOREIGN PATENT DOCUMENTS

CA 2918863 A1 2/2015
DE 691 25 651 9/1997
(Continued)

OTHER PUBLICATIONS

Eloxal-Verfahren (Anodizing process), in Wikipedia, Apr. 29, 2018.
(Continued)

*Primary Examiner* — Daniel J. Schleis
(74) *Attorney, Agent, or Firm* — Henry M. Feiereisen LLC

(57) ABSTRACT

In an aluminium-based coating for steel sheets or steel strips, the coating includes an aluminium-based coat applied in a hot-dip coating method, a covering layer containing aluminium oxide and/or hydroxide being arranged on the coat. The covering layer is produced by plasma oxidation and/or hot water treatment at temperatures of at least 90° C., advantageously at least 95° C., and/or steam treatment at
(Continued)

temperatures of at least 90° C., advantageously at least 95° C. Alternatively, the covering layer containing aluminium oxide and/or hydroxide can be produced by anodic oxidation, the coat being produced in a molten bath with a Si content of between 8 and 12 wt. %, and an Fe content of between 1 and 4 wt. %, the remainder being aluminium.

19 Claims, 3 Drawing Sheets

(51) Int. Cl.

| | |
|---|---|
| ***C21D 9/46*** | (2006.01) |
| ***C23C 8/36*** | (2006.01) |
| ***C23C 8/42*** | (2006.01) |
| ***C23C 2/26*** | (2006.01) |
| ***C21D 1/673*** | (2006.01) |
| ***C21D 8/02*** | (2006.01) |
| ***C21D 9/52*** | (2006.01) |
| ***C22C 21/02*** | (2006.01) |
| ***C23C 2/28*** | (2006.01) |
| ***C23C 28/00*** | (2006.01) |
| *C25D 11/04* | (2006.01) |

(52) U.S. Cl.

CPC ..... *C21D 9/52* (2013.01); *C22C 21/02* (2013.01); *C23C 2/26* (2013.01); *C23C 2/28* (2013.01); *C23C 2/40* (2013.01); *C23C 8/36* (2013.01); *C23C 8/42* (2013.01); *C23C 28/321* (2013.01); *C23C 28/345* (2013.01); *C25D 11/04* (2013.01); *Y10T 428/12757* (2015.01)

(56) References Cited

U.S. PATENT DOCUMENTS

| | | | |
|---|---|---|---|
| 2011/0300407 | A1 | 12/2011 | Cho et al. |
| 2012/0305139 | A1 | 12/2012 | Luther et al. |
| 2013/0068350 | A1 | 3/2013 | Steins et al. |
| 2015/0020992 | A1 | 1/2015 | Luther et al. |
| 2015/0041024 | A1 | 2/2015 | Luther et al. |
| 2015/0047753 | A1 | 2/2015 | Luther et al. |
| 2016/0215376 | A1 | 7/2016 | Luther et al. |
| 2016/0281252 | A1 | 9/2016 | Luther et al. |
| 2017/0198152 | A1 | 7/2017 | Blumenau et al. |

FOREIGN PATENT DOCUMENTS

| | | | |
|---|---|---|---|
| DE | 197 26 363 | | 12/1998 |
| DE | 60119826 | T2 | 12/2006 |
| DE | 69933751 | T2 | 10/2007 |
| DE | 102011053634 | | 3/2013 |
| DE | 102014109943 | | 11/2015 |
| EP | 0204423 | A2 | 12/1986 |
| EP | 0575926 | A1 | 12/1993 |
| EP | 0 531 183 | | 4/1998 |
| EP | 2449138 | | 5/2012 |
| EP | 2843081 | A1 | 3/2015 |
| GB | 2159839 | A | 12/1985 |
| JP | H 06-116737 | | 4/1994 |
| JP | 2010-263037 | | 11/2010 |
| JP | 2014-213360 | A | 11/2014 |
| KR | 10-2010-0082537 | | 7/2010 |
| WO | WO 2014/037627 | A1 | 3/2014 |
| WO | WO 2014/059476 | A1 | 4/2014 |
| WO | WO 2015/098653 | A1 | 7/2015 |

OTHER PUBLICATIONS

International Search Report issued by the European Patent Office in International Application PCT/EP2017/052266.

Chinese Search Report dated Sep. 22, 2019 with respect to counterpart Chinese patent application 2017800094405.

Translation of Chinese Search Report dated Sep. 22, 2019 with respect to counterpart Chinese patent application 20178000-94405.

METHOD FOR PRODUCING PRESS-HARDENED COMPONENTS CONSISTING OF STEEL SHEETS OR STEEL STRIPS COMPRISING AN ALUMINIUM-BASED COATING, AND PRESSED-HARDENED COMPONENT THEREFROM

CROSS-REFERENCES TO RELATED APPLICATIONS

This application is the U.S. National Stage of International Application No. PCT/EP2017/052266, filed Feb. 2, 2017, which designated the United States and has been published as International Publication No. WO 2017/137304 and which claims the priorities of German Patent Applications, Serial Nos. 10 2016 102 172.5, filed Feb. 8, 2016, and 10 2016 102 504.6, filed Feb. 12, 2016, pursuant to 35 U.S.C. 119(a)-(d).

BACKGROUND OF THE INVENTION

The invention relates to an aluminium-based coating for steel sheets or steel strips, wherein the coating comprises an aluminium-based coat which is applied in the hot-dipping method and wherein a cover layer containing aluminium oxide and/or aluminium hydroxide is arranged on the coat. The invention also relates to a method for producing a steel sheet or steel strip comprising an aluminium-based coating, wherein an aluminium-based coat is applied as the coating onto the steel sheet or steel strip in the hot-dipping method. Furthermore, the invention relates to a method for producing press-hardened components consisting of steel sheets or steel strips comprising an aluminium-based coating and produced according to the aforementioned method. In addition, the invention relates to a press-hardened component consisting of steel sheets or steel strips comprising an aluminium-based coating and produced according to the aforementioned method.

It is known that hot-formed steel sheets are being used with increasing frequency in automotive engineering. By means of the process which is defined as press-hardening, it is possible to produce high-strength components which are used predominantly in the region of the bodywork. Press-hardening can fundamentally be carried out by means of two different method variations, namely by means of the direct or indirect method. Whereas the process steps of forming and hardening are performed separately from one another in the indirect methods, they take place together in one tool in the direct method. However, only the direct method will be considered hereinafter.

In the direct method, a steel sheet plate is heated above the so-called austenitization temperature (Ac3), the thus heated plate is then transferred to a forming tool and formed in a single-stage formation step to make a finished component and in this case is cooled by the cooled forming tool simultaneously at a rate above the critical cooling rate of the steel so that a hardened component is produced.

Known hot-formable steels for this area of application are e.g. the manganese-boron steel "22MnB5" and latterly also air-hardenable steels according to European patent EP 2 449 138 B1.

In addition to uncoated steel sheets, steel sheets comprising scaling protection for press-hardening are also used in the automotive industry. The advantages here are that, in addition to the increased corrosion resistance of the finished component, the plates or components do not become scaled in the furnace, whereby wearing of the pressing tools by flaked-off scales is reduced and the components often do not have to undergo costly blasting prior to further processing.

Currently, the following (alloy) coatings which are applied by hot-dipping are known for press-hardening: aluminium-silicon (AS), zinc-aluminium (Z), zinc-aluminium-iron (ZF/galvannealed), zinc-magnesium-aluminium-iron (ZM) and electrolytically deposited coatings of zinc-nickel or zinc, wherein the latter is converted to an iron-zinc alloy layer prior to hot-forming. These corrosion protection coatings are conventionally applied to the hot or cold strip in continuous feed-through processes.

German laid-open document DE 197 26 363 A1 describes a plated metal strip comprising a main body consisting of a carbon-containing steel which is provided on one side or both sides with a support material consisting of a non-ferrous metal. Aluminium or an aluminium alloy is proposed as the support material. The support material is also subjected to nitration or anodic oxidation in order to increase the wear resistance and corrosion resistance of the surface of the support material.

The patent document DE 10 2014 109 943 B3 discloses the production of a steel product comprising a metallic corrosion protection coating consisting of an aluminium alloy. After activation of the surface, i.e. after removal of a passive oxide layer from the surface, the cold-rolled or hot-rolled steel product is coated by being dipped into a molten coating bath. This molten coating bath contains, in addition to Al and unavoidable impurities, Mn and/or Mg, Fe, Ti and/or Zr. This is intended to increase the corrosion resistance compared with AlSi alloys. This corrosion protection coating can additionally be anodised.

The production of components by means of quenching of pre-products consisting of press-hardenable steels by hot-forming in a forming tool is known from German patent DE 601 19 826 T2. In this case, a sheet plate previously heated above the austenitization temperature to 800-1200° C. and possibly provided with a metallic coat of zinc or on the basis of zinc is formed in an occasionally cooled tool by hot-forming to produce a component, wherein during forming, by reason of rapid heat extraction, the sheet or component in the forming tool undergoes quench-hardening (press-hardening) and obtains the required strength properties owing to the resulting martensitic hardness structure.

The production of components by means of quenching of pre-products which are coated with an aluminium alloy and consist of press-hardenable steels by hot-forming in a forming tool is known from German patent DE 699 33 751 T2. In this case, a sheet which is coated with an aluminium alloy is heated to above 700° C. prior to forming, wherein an intermetallic alloyed compound on the basis of iron, aluminium and silicon is produced on the surface and subsequently the sheet is formed and cooled at a rate above the critical cooling rate.

The advantage of the aluminium-based coats resides in the fact that, in addition to a larger process window (e.g. in terms of the heating parameters), the finished components do not have to be subjected to blasting prior to further processing. Furthermore, in the case of aluminium-based coats there is no risk of liquid metal embrittlement and micro-cracks cannot form in the near-surface substrate region on the former austenite grain boundaries which, at depths greater than 10 μm, can have a negative effect on the fatigue strength.

However, one difficulty in using aluminium-based coats is that, during heating of a steel plate in the roller hearth furnace prior to hot-forming, the coat can react with the ceramic transport rollers, which significantly reduces the service life of the furnace rollers. Furthermore, the wear on the tools is very high during press-hardening as a result of the aluminium-silicon coat which is thoroughly alloyed with iron as part of the heating procedure. Moreover, a non-uniform formation of the surface structure or of the thickness of the coat during heating leads to welding problems, in particular in resistance spot welding which is frequently used in the automotive industry, caused as a result of locally varying electrical resistances on the component surface.

However, problems occur even in the cold-forming of aluminium-based coats. For example, the abrasion during forming in the tool is considerably higher compared with standard zinc coats, which increases tool wear and maintenance outlay and can lead to flaws in subsequent parts caused by the abrasion being pressed in.

SUMMARY OF THE INVENTION

Therefore, the object of the invention is to provide an aluminium-based coat for a steel sheet or steel strip which has excellent suitability for hot-forming and cold-forming. Furthermore, a method for producing such a coating is to be provided as well as a method for producing press-hardened components consisting of such steel sheets or steel strips and a press-hardened component consisting of such steel sheets or steel strips.

The teaching of the invention includes an aluminium-based coating for steel sheets or steel strips, wherein the coating comprises a coat which is applied in the hot-dipping method and which is characterised in that a cover layer containing aluminium oxide and/or aluminium hydroxide is arranged on the coat and has been produced by plasma oxidation and/or a hot water treatment at temperatures of at least 90° C., advantageously at least 95° C. and/or a steam treatment at temperatures of at least 90° C., advantageously at least 95° C. In this case, the coat can be advantageously produced in a melting bath with an Si content of 8 to 12 wt. %, an Fe content of 1 to 4 wt %, with the remainder being aluminium.

Aluminium-based coats are understood hereinafter to be metallic coats, in which aluminium is the main constituent in mass percent. Examples of such aluminium-based coats are aluminium, aluminium-silicon (AS), aluminium-zinc-silicon (AZ), and the same coats with admixtures of additional elements, such as e.g. magnesium, manganese, titanium and rare earths.

Moreover, the teaching of the invention includes an aluminium-based coating for steel sheets or steel strips, wherein the coating comprises an aluminium-based coat which is applied in the hot-dipping method and wherein a cover layer containing aluminium oxide and/or aluminium hydroxide is arranged on the coat and has been produced by anodic oxidation, characterised in that the coat has been produced in a melting bath comprising an Si content of 8 to 12 wt. %, an Fe content of 1 to 4 wt. %, with the remainder being aluminium.

However, the formation of a defined cover layer, containing aluminium oxide and/or aluminium hydroxide, on the aluminium-based coating can considerably reduce or even completely prevent the aforementioned negative aspects of aluminium-based coatings.

DETAILED DESCRIPTION OF PREFERRED EMBODIMENTS

Figure 1:
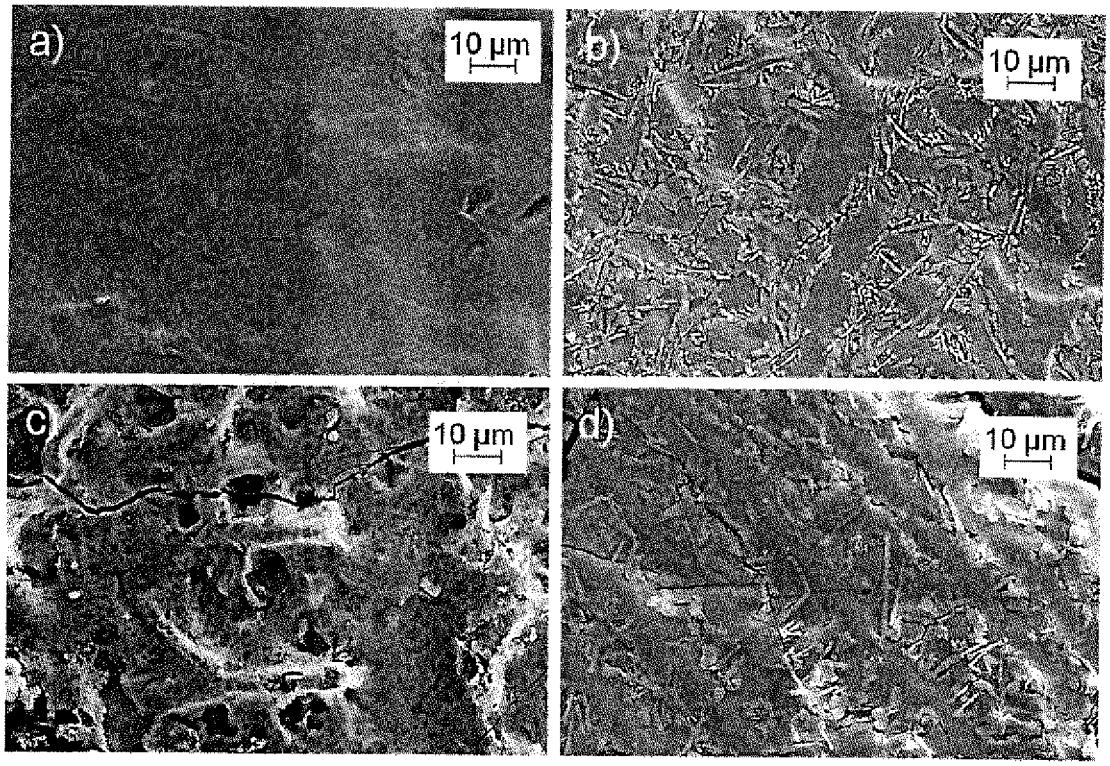
FIGS. 1*a*) to 1*d*) show various surface images of an aluminium-silicon (AS) coat.

The invention relates to an aluminium-based coating for steel sheets or steel strips, wherein the coating comprises an aluminium-based coat which is applied in the hot-dipping method and wherein a cover layer containing aluminium oxide and/or aluminium hydroxide is arranged on the coat and has been produced by anodic oxidation. In the case of hot-forming, the cover layers containing aluminium oxide and/or aluminium hydroxide function as a separation layer between the coat and the ceramic furnace rollers. Therefore, the transfer of metallic material to the furnace rollers is effectively avoided. Furthermore, the cover layer containing aluminium oxide and/or aluminium hydroxide separates the aluminium-based coat of the steel strip, which has iron alloyed thereon, from the metallic tool surface of the forming tool and thus serves as a separating forming aid. This reduces wear and abrasion and thus tool wear and maintenance because as a result of the press-hardening the layers are changed to a considerably lesser extent and thus become considerably less abrasive than in the case of the prior art. This is illustrated in FIGS. 1 a) to d). These figures illustrate a comparison of examples of scanning electron microscope images of the surface of an AS coat a) untreated initial state without press-hardening, b) anodised state without press-hardening, c) untreated state after press-hardening, d) anodised state after press-hardening.

An alkaline pre-treatment in advance of the production of the cover layer with occasionally subsequent acid deoxidation e.g. with sulphuric acid or nitric acid and subsequent rinsing of the steel sheet or steel strip provided with an aluminium-based coating advantageously removes the arbitrarily formed layer already produced by atmospheric oxidation and thereby provides a defined initial state for the subsequently produced cover layer.

However, it represents a challenge in terms of mass production to produce defined cover layers, which contain aluminium oxide and/or aluminium hydroxide, on a steel strip comprising an aluminium-based coat.

In accordance with the invention, the cover layer containing aluminium oxide and/or aluminium hydroxide is thus produced in accordance with the invention by means of plasma oxidation. In addition or alternatively, a hot water treatment can be performed at temperatures of at least 90° C., advantageously at least 95° C. or a steam treatment can be performed at temperatures of at least 90° C., advantageously at least 95° C. This type of treatment of the coat or of the cover layer is also called compaction.

Furthermore, the cover layer containing aluminium oxide and/or aluminium hydroxide is produced in an anodic method. In this case, the coat can be produced in a melting bath with an Si content of 8 to 12 wt. %, an Fe content of 1 to 4 wt. %, with the remaining being aluminium. The anodic method is considerably more versatile compared with a chemical oxidation method. It is particularly advantageous to perform this method in a continuous process on a coated steel strip.

The anodic oxidation of an aluminium (alloy) layer can be performed both in the direct current method and alternating current method.

If aluminium or aluminium layers are anodically treated e.g. in a sulphuric acid electrolyte, then in the electrical field which forms, the negatively charged sulphate anions of the sulphuric acid and the OH— ions of the water migrate to the anode. At the anode, these react with $Al^{3}+$ ions, forming aluminium oxide. According to Faraday's Laws, the layer thickness is dependent upon the charge quantity passed. This makes it possible to adjust the thickness of the oxide layer in a defined manner in order thus to tailor it to the respective intended use.

For the anodic oxidation of aluminium, in the literature a layer thickness of about 20 μm is formed at an electrical continuity of 1 $Ah/dm^2$.

In tests, layers which are thick enough to ensure separation between the furnace roller and the coat have proven to be advantageous. By way of example, average layer thicknesses of at least 0.05 μm and at most 4.0 μm have proven to be advantageous and at the same time still permit a good welding capability, in particular a spot welding capability.

Layers which on average are between 0.1 and 1.0 μm have proven to be particularly advantageous because in this case a clearly positive effect has been found in terms of a reduction in tool wear and also there is no restriction whatsoever in terms of welding suitability.

For the anodic oxidation of aluminium and aluminium alloys, different electrolyte systems are taken into consideration (e.g. on the basis of boric acid, citric acid, sulphuric acid, oxalic acid, chromic acid, alkyl sulphonic acids, carboxylic acids, alkali carbonates, alkali phosphates, phosphoric acid, hydrofluoric acid).

Typical current densities for the process are between 1-50 $A/dm^2$ depending upon the electrolyte system. Since the process operates at a constant current, a voltage is produced. This is typically in a range of 10-120 V. The electrolyte temperature is between 0-65° C. depending upon the electrolyte system. By way of example, the hardness of the layer can be influenced by the selection of electrolyte temperature. In electrolytes on the basis of sulphuric acid or oxalic acid, particularly hard layers are obtained at low electrolyte temperatures (e.g. 0-10° C.).

During the anodic oxidation, a nanoporous oxide layer which covers the entire surface is formed from oxide cells which are densely combined and have hexagonal cross-sections. These pores are open towards the electrolyte side. The pore diameter depends upon the type of electrolyte used. Depending upon the local chemical composition of the coat located thereunder, the oxide layer can be formed locally in different phases (see FIG. 1*b*). In tests, it has been demonstrated in a sulphuric acid-direct current method that, during the anodic treatment, the phases included in an AS alloy coat behave differently in relation to the oxide layer thickness and pore size on a microscopic level. Therefore, a microstructure is formed which is different from the original metallic surface. On a macroscopic level, the layer formation is effected very homogeneously.

Figure 2:
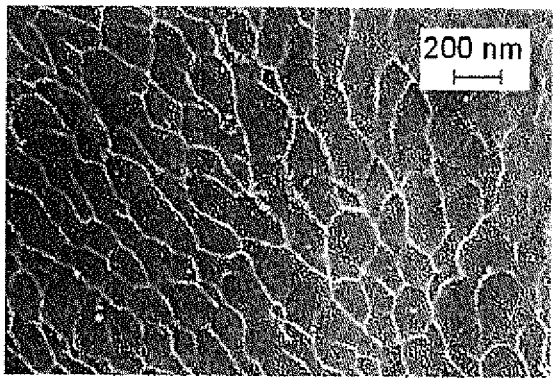
FIG. 2 shows a scanning electron microscope image of the nanoporous surface structure of an anodised AS coat.

FIG. 2 shows by way of example a scanning electron microscope image of the nanoporous surface structure of an anodised AS coat. The nanoporous layer which is formed can have dyestuffs (organic or inorganic) or functional pigments (e.g. conductive, metallic particles, fullerenes, nano-structured particles) incorporated therein, by means of which the colouration and properties of the layer, such as e.g. the electrical conductivity, hardness, corrosion protection, antibacterial properties, can be tailored.

The compaction step which advantageously follows on therefrom and is also called "sealing" closes the pore structure through the absorption of water of crystallisation and prevents e.g. further absorption of dyestuffs or functional pigments. The compaction can be achieved by a steam treatment or hot water treatment. Temperatures of at least 90° C., in a particularly advantageous manner at least 95° C., have proven to be advantageous for this purpose. The compaction time is dependent upon the oxide layer thickness. In this case, the compaction time is also increased as the oxide layer thickness increases. Additives, such as e.g. metal salts, can advantageously improve the corrosion resistance and colour fastness during compaction.

In general, the presence of iron disrupts the anodic oxidation of aluminium and aluminium alloys. Therefore, it is necessary to ensure that iron consisting of the steel substrate does not come into contact with the electrolyte. Therefore, in the case of coated plates the cut edges must be protected in a complex manner (e.g. by flanges, edge masks, coatings, paint coats, films). When a coated (non-foamed) steel strip is being anodised, no steel is exposed at the strip edges because they are also coated in the hot-dipping process. This simplifies the process of anodic oxidation considerably and at the same time safeguards its stability.

Furthermore, it would be feasible to perform an inventive surface treatment of the aluminium-based layer only on one side in order to achieve e.g. only a positive effect in terms of the durability of the furnace rollers. It is also conceivable to perform an inventive surface treatment which is different on both sides.

Tests have demonstrated that for samples which have been subjected to a steam treatment for the purpose of compaction, a thin oxide layer which can be used in accordance with the invention has also been achieved without preceding anodisation or plasma oxidation.

In an advantageous manner, the aluminium-based coat has particular suitability for hot-forming or cold-forming.

The method in accordance with the invention includes the production of a steel sheet or steel strip comprising an aluminium-based coating, wherein an aluminium-based coat is applied as the coating onto the steel sheet or steel strip in the hot-dipping method, characterised in that the coated steel sheet or steel strip comprising the coat is subjected to plasma oxidation and/or a hot water treatment and/or steam treatment after the hot-dipping process and prior to the forming process of hot-forming or cold-forming, wherein a cover layer containing aluminium oxide and/or aluminium hydroxide is formed on the surface of the coat, with oxides or hydroxides being formed. In this case, the coat can be advantageously produced in a melting bath with an Si content of 8 to 12 wt. %, an Fe content of 1 to 4 wt. %, with the remainder being aluminium.

In an advantageous manner, the optional hot water treatment or the treatment with steam is performed at temperatures of at least 90° C., in a particularly advantageous manner at least 95° C.

A further method in accordance with the invention includes the production of a steel sheet or steel strip comprising an aluminium-based coating, wherein an aluminium-based coating is applied as the coating onto the steel sheet or steel strip in the hot-dipping method, wherein the steel sheet or steel strip comprising the coating is subjected to anodic oxidation after the hot-dipping process and prior to the forming process, wherein a cover layer containing aluminium oxide and/or aluminium hydroxide is formed on the surface of the coat, with oxides or hydroxides being formed, characterised in that the coat is produced in a melting bath with an Si content of 8 to 12 wt %, an Fe content of 1 to 4 wt. %, with the remainder being aluminium.

In one advantageous embodiment of the invention, the cover layer is applied onto the surface of the coat in a continuous process.

The anodic oxidation in accordance with the invention is effected advantageously in a medium on the basis of boric acid, citric acid, sulphuric acid, oxalic acid, chromic acid, alkyl sulphonic acids, carboxylic acids, alkali carbonates, alkali phosphates, phosphoric acid or hydrofluoric acid.

Current densities between 1-50 A/dm$^2$, a voltage of 10-120 V and an electrolyte temperature between 0-65° C. have proven to be advantageous method parameters for anodisation.

In one advantageous development of the invention, provision is made that after the step of anodisation and/or plasma oxidation of the coating and prior to compaction of the coat by hot water treatment and/or steam treatment, colour pigments and/or pigments influencing the function of the cover layer are incorporated into the cover layer of the coating. As a result, it is possible to freely configure the colour of the surface of the coated steel sheet or steel strip, or the functional properties of the coating can be adjusted in a targeted manner in terms of the requirements imposed, as described above.

In a further advantageous development of the invention, the aluminium-based coat which is produced by the method in accordance with the invention has particular suitability for hot-forming or cold-forming.

A method is provided for press-hardening components consisting of the inventive steel sheets or steel strips provided with an aluminium-based coating, characterised in that the steel sheets or steel strips are heated, with the aim of hardening, to a temperature above Ac3 at least in regions, are then formed at this temperature and subsequently are cooled at a rate which, at least in regions, is above the critical cooling rate, wherein the aluminium-based coating is a coat which is applied in the hot-dipping method, wherein, after the hot-dipping process and prior to the heating to forming temperature, the coating is subjected to a treatment under anodising conditions and/or plasma oxidation and/or a hot water treatment and/or steam treatment, in which the coating is oxidised on the surface with oxides or hydroxides being formed and the coat is produced in a melting bath with an Si content of 8 to 12 wt. %, an Fe content of 1 to 4 wt. %, with the remainder being aluminium.

Furthermore, the invention comprises a press-hardened component consisting of the inventive steel sheets or steel strips provided with an aluminium-based coating, produced according to the previously described method.

The tests have revealed further properties which are also advantageous for cold-formed components or relate to the cold-forming procedure itself:

a) The inventive cover layer containing aluminium oxide and/or aluminium hydroxide separates the metallic aluminium-based coat of the steel strip from the metallic tool surface of the forming tool and thus serves as a separating forming aid. This reduces welds and expands the forming region by lowering the friction resistance and avoiding the so-called stick-slip effect. This problem occurs particularly at slow forming rates and with very high-strength materials and can greatly limit the process window. By virtue of the layer in accordance with the invention, the process window is opened considerably at lower rates and higher forming forces and therefore the forming process becomes substantially more robust. Furthermore, it is beneficial to the forming process that by reason of the laterally heterogeneous formation of the cover layer containing aluminium oxide and/or aluminium hydroxide, it is not surface contact but instead reduced contact which occurs between the workpiece and tool.

b) At the same time, the porous surface of the inventive cover layer containing aluminium oxide and/or aluminium hydroxide can increase the oil absorption of the surface and greatly reduce the effect of oil displacement. Steel coils, i.e. steel strips wound up into rolls, are already oiled by the manufacturer so that, on the one hand, corrosion protection is ensured prior to processing by the customer and, on the other hand, pre-oiling is provided for subsequent forming processes. This oil can leak out of the coil windings when it is intermediately stored for lengthy periods and subjected to elevated temperatures. Therefore, it is not provided on the sheet surface which gives rise to the need for costly re-oiling. This can be prevented with the cover layer configured in accordance with the invention.

c) The greater hardness of the inventive cover layer, which contains aluminium oxide and/or aluminium hydroxide, of up to 350 HV 0.025 compared with the metallic coat facilitates the use of this system for applications, in which smooth surfaces having minimised rolling resistance are important, such as bearing surfaces, bushings or pull-out mechanisms of e.g. drawers. In this case, in the case of metallic coats there is also the risk of cold welding and thus of the build-up of material on the bearing surfaces which significantly influences the function of a sliding or rolling bearing.

d) The inventive cover layer containing aluminium oxide and/or aluminium hydroxide produces, when subjected to corrosive loading, a barrier effect which protects the metallic corrosion coat itself. Metallic coats protect the fine steel sheet by a) coverage and b) cathodic corrosion protection in the event of damage to the surface. In conjunction with a further barrier layer (e.g. lacquer), reference is made to so-called duplex layer systems. Although lacquers have a strong vapour barrier with respect to water, they are generally not very abrasion-resistant. The inventive cover layer containing aluminium oxide and/or aluminium hydroxide solves this problem by combining a barrier effect with high abrasion resistance. Furthermore, the layers in accordance with the invention are considerably more temperature-resistant than all of the known lacquers and thus permit use in corrosive environments even at elevated temperature.

e) Furthermore, oxide growth at high temperatures is very greatly reduced because the ion exchange required for the growth of an oxide layer is prevented by the surface owing to the atomically compact configuration of the layer. Likewise, vaporisation of the coat is efficiently prevented.

f) A further advantage over a purely metallic surface resides in the increased resistance to acidic and in particular alkaline media. In this case, the inventive cover layer containing aluminium oxide and/or aluminium hydroxide functions like a separation layer which protects against the caustic effect of these media.

g) At the same time, the cover layer in accordance with the invention can be lacquered very effectively even without any preceding phosphate-coating because it permits ideal chemical cross-linking by reason of its inorganic nature and permits very effective physical cross-linking by reason of the large surface (when the compacting step is omitted).

h) The inventive cover layer containing aluminium oxide and/or aluminium hydroxide efficiently increases the electrical resistance of the surface so that depending upon the layer thickness (also above 20 μm) electrical breakdown voltages of up to 2 kV can be achieved without a protective lacquer.

i) By reason of the porosity of the cover layers containing aluminium oxide and/or aluminium hydroxide, it is possible to embed pigments prior to the compaction process. Brightly coloured aluminium surfaces are known and widely used in the field of decorative anodised coatings on aluminium components. However, in addition to colour information, other technical properties, such as e.g. electrical conductivity or antibacterial effect, can also be tailored by means of such pigments.

Figure 3:
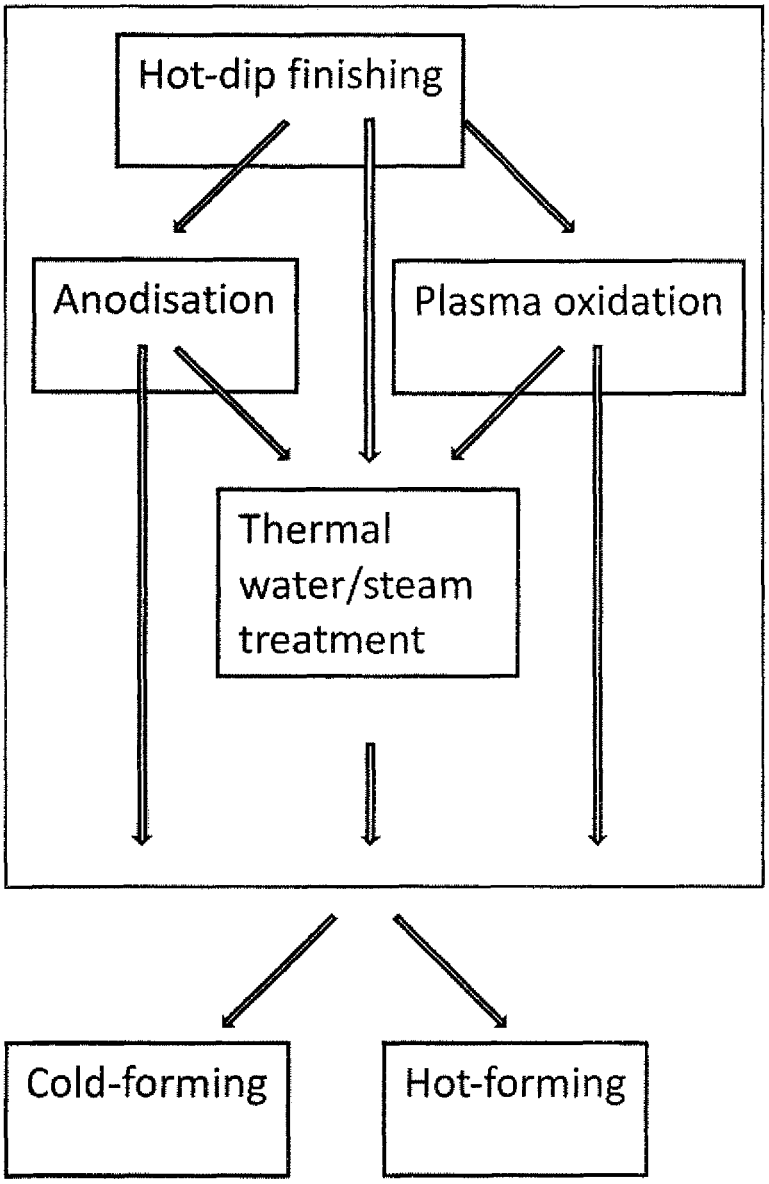
FIG. 3 is a process diagram for producing aluminium-based steel sheets or steel strips for the hot-forming or cold-forming processes.

Some possible process routes for producing aluminium-based steel sheets or steel strips for the hot-forming or cold-forming processes are described hereinafter. They are apparent from the general process diagram shown in FIG. 3.

PROCESS EXAMPLE I

A) Hot-dip finishing (aluminium-based coat)
B) Anodisation
1. Alkaline pre-treatment (with/without surfactants)
2. Acid deoxidation (e.g. sulphuric acid, nitric acid . . . )
3. Rinsing
4. Anodisation process
5. Rinsing
6. Colouring/application of functional pigments
7. Rinsing
8. Thermal water/steam treatment process (compaction process)
9. Drying
C) Hot-forming process

PROCESS EXAMPLE II

A) Hot-dip finishing (aluminium-based coat)
B) Anodisation
1. Alkaline pre-treatment (with/without surfactants)
2. Acid deoxidation (e.g. sulphuric acid, nitric acid . . . )
3. Rinsing
4. Anodisation process
5. Rinsing
6. Colouring I application of functional pigments
7. Rinsing
8. Thermal water/steam treatment process (compaction process)
9. Drying
C) Cold-forming process

PROCESS EXAMPLE III

A) Hot-dip finishing (aluminium-based coat)
B) Plasma oxidation
1. Alkaline pre-treatment (with/without surfactants)
2. Acid deoxidation (e.g. sulphuric acid, nitric acid . . . )
3. Rinsing
4. Drying
5. Plasma etching
6. Plasma oxidation process
C) Hot-forming process or cold-forming process

PROCESS EXAMPLE IV

A) Hot-dip finishing (aluminium-based coat)
B) Thermal water/steam treatment
1. Alkaline pre-treatment (with/without surfactants)
2. Acid deoxidation (e.g. sulphuric acid, nitric acid . . . )
3. Rinsing
4. Thermal water/steam treatment process
5. Drying
C) Hot-forming process or cold-forming process

What is claimed is:

1. A method for producing a press-hardened component of steel sheet or steel strip, said method comprising:

applying an aluminium-based coat onto the steel sheet or steel strip in a hot-dipping process;

subjecting the coated steel sheet or steel strip to plasma oxidation and/or a hot water treatment and/or steam treatment and/or anodic oxidation after the hot-dipping process to thereby form while forming oxides or hydroxides a cover layer containing aluminium oxide and/or aluminium hydroxide on a surface of the coat;

heating the steel sheet or steel strip for hardening to a temperature above Ac3 at least in a region thereof;

forming the steel sheet or steel strip at the temperature; and cooling the steel sheet or steel strip at a rate which, at least in a region thereof, is above a critical cooling rate.

2. The method of claim 1, wherein the coat is produced in a melting bath with an Si content of 8 to 12 wt. %, an Fe content of 1 to 4 wt. %, with the remainder being aluminium.

3. The method of claim 1, wherein the hot water treatment or the treatment with steam is performed at a temperature of at least 90° C.

4. The method of claim 1, wherein the hot water treatment or the treatment with steam is performed at a temperature of at least 95° C.

5. The method of claim 1, wherein the cover layer is applied onto the surface of the coat in a continuous process.

6. The method of claim 1, wherein the cover layer is applied having an average layer thickness less than 4 μm and greater than 0.05 μm.

7. The method of claim 1, wherein the cover layer is applied having an average layer thickness less than 1.0 μm and greater than 0.1 μm.

8. The method of claim 1, wherein the anodic oxidation is effected in a medium on a basis of boric acid, citric acid, sulphuric acid, oxalic acid, chromic acid, alkyl sulphonic acids, carboxylic acids, alkali carbonates, alkali phosphates, phosphoric acid, hydrofluoric acid.

9. The method of claim 1, wherein anodisation is effected at a current density between 1-50 A/dm$^2$ and a voltage of 10-120 V and an electrolyte temperature between 0-65° C.

10. The method of claim 1, further comprising introducing colour pigments and/or pigments into the cover layer for influencing a function of the cover layer after anodisation and/or plasma oxidation of the coat and prior to hot water treatment and/or steam treatment.

11. The method of claim 1, further comprising introducing an element influencing an electrical conductivity and/or an antibacterial property of the cover layer as a function-influencing pigment.

12. The method of claim 1, further comprising introducing conductive, metallic particles, fullerenes, nano-structured particles as function-influencing pigments.

13. A press-hardened component of steel sheet or steel strip, said press-hardened component comprising an aluminium-based coating, produced according to a method as set forth in claim 1.

14. The press-hardened component of claim 13, wherein the aluminium-based coating forms a cover layer containing aluminium oxide and/or aluminium hydroxide on a surface of the coating.

15. The press-hardened component of claim 14, wherein the cover layer has an average layer thickness less than 4 μm and greater than 0.05 μm.

16. The press-hardened component of claim 14, wherein the cover layer has an average layer thickness less than 1.0 μm and greater than 0.1 μm.

17. The press-hardened component of claim 14, wherein the cover layer includes colour pigments and/or pigments for influencing a function of the cover layer.

18. The press-hardened component of claim 14, wherein the cover layer includes an electrical conductivity influencing element and/or antibacterial property influencing element.

19. The press-hardened component of claim 14, wherein the cover layer includes conductive, metallic particles, fullerenes, nano-structured particles as function-influencing pigments.

* * * * *